US011344070B2

(12) United States Patent
Sandoval

(10) Patent No.: US 11,344,070 B2
(45) Date of Patent: May 31, 2022

(54) JACKET WITH BACK SIDE CLOSURE

(71) Applicant: Reyna Sandoval, Harriman, NY (US)

(72) Inventor: Reyna Sandoval, Harriman, NY (US)

( * ) Notice: Subject to any disclaimer, the term of this patent is extended or adjusted under 35 U.S.C. 154(b) by 0 days.

(21) Appl. No.: 16/948,630

(22) Filed: Sep. 25, 2020

(65) Prior Publication Data

US 2022/0095705 A1 Mar. 31, 2022

(51) Int. Cl.
*A41D 1/02* (2006.01)

(52) U.S. Cl.
CPC ..... *A41D 1/02* (2013.01)

(58) Field of Classification Search
CPC ..... A41D 1/02; A41D 3/02; A41D 2300/30
USPC ..... 2/93, 128
See application file for complete search history.

(56) References Cited

U.S. PATENT DOCUMENTS 5,806,094 A * 9/1998 Kasun ..... A41H 43/00 2/115
5,911,312 A 6/1999 Holyfield
6,401,248 B1 * 6/2002 Christensen ..... A41D 3/08 2/69
9,498,007 B2 11/2016 Rizk
10,165,809 B2 1/2019 Tong
2007/0033700 A1 2/2007 Gonya
2007/0118950 A1 * 5/2007 Hogge ..... A41D 1/02 2/69
2008/0196139 A1 8/2008 Eng
2009/0106872 A1 4/2009 Collins
2012/0174285 A1 7/2012 Williams et al.
2013/0007940 A1 1/2013 Ryerson
2015/0327612 A1 * 11/2015 Bublitz ..... A41D 15/005 2/202
2017/0055604 A1 * 3/2017 Clauder ..... A41D 13/1236
2017/0238623 A1 8/2017 Wallace et al.
2018/0199638 A1 7/2018 Byrne
2018/0360131 A1 12/2018 Wade
2019/0166930 A1 6/2019 Stewart et al.
2019/0307179 A1 10/2019 Beard
2019/0313702 A1 10/2019 Karp et al.
2020/0068960 A1 3/2020 Oliver et al.
2020/0383399 A1 * 12/2020 Rizk ..... A41D 3/00

* cited by examiner

*Primary Examiner* — Gloria M Hale
(74) *Attorney, Agent, or Firm* — Dunlap Bennett & Ludwig, PLLC

(57) ABSTRACT

A jacket includes a first back flap, a main body including a front portion and second back flap, and a pair of sleeves. The first back flap and the second back flap are detachably connectable to one another to selectively open and close an opening on the back side of the jacket. The first back flap may include a first connector disposed on an upper end of the first back flap and the second back flap may include a second connector disposed on an upper end of the second back flap, the first connector and the second connector being detachably connectable to one another to facilitate the opening and closing of the opening in the jacket. The jacket may also include a hood detachably connectable to a collar on the first back flap.

9 Claims, 3 Drawing Sheets

JACKET WITH BACK SIDE CLOSURE

BACKGROUND OF THE INVENTION

The present invention relates to jackets and, more particularly, to a jacket, configured for children, that opens on the rear/back side to allow for easy removal when a child is in a sitting position.

Conventional jackets open from the front by various means, such as zippers, buttons, snap fasteners, etc. When a child is in a seated position, such as in a car seat in a vehicle, this configuration makes it very difficult to take off the jacket because the portion of the jacket that needs to be pulled is wedged between the child's back and the seat back. Not only that, but oftentimes the jacket will need to be put back on prior to exiting the vehicle, which poses similar problems as removing the jacket.

It is a manual, and quite often, frustrating process for both the child and the individual attempting to put or take the jacket on/off the child. Furthermore, because a person's arms do not as naturally bend backwards as they do forwards, the jacket must be pulled off one arm at a time, increasing the amount of time and effort to remove the jacket from the child.

As can be seen, there is a need for a jacket designed to alleviate these aforementioned problems.

SUMMARY OF THE INVENTION

In one aspect of the present invention, a jacket defines a front side and a back side, and the jacket comprises: a first back flap; and a main body including a front portion and a second back flap, the first back flap and the second back flap being detachably connectable to one another to selectively open and close an opening on the back side of the jacket.

In another aspect of the present invention, a garment defines a front side and a back side, and the garment comprises: a first back flap comprising a first connector disposed on an upper end of the first back flap; a main body including a front portion and a second back flap, the second back flap comprising a second connector disposed on an upper end of the second back flap; and a pair of sleeves at least partially connected to the main body, the first back flap and the second back flap being detachably connectable to one another via selective coupling and uncoupling of the first connector and the second connector to open and close an opening on the back side of the garment.

In yet another aspect of the present invention, a garment defines a front side and a back side, and the garment comprises: a first back flap; a collar connected to an upper end of the first back flap; a hood connected to the collar; a main body including a front portion and a second back flap; a pair of sleeves at least partially connected to the main body; and the first back flap and the second back flap being detachably connectable to one another to selectively open and close an opening on the back side of the garment.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a jacket defining a front side and a back side, the jacket including a first back flap and a main body that includes a front portion and a second back flap, the first back flap and the second back flap being detachably connectable to one another to selectively open and close an opening in the jacket that is disposed on its back side. While the present invention is largely described in the context of a child's use, it will be understood and appreciated by those with skill in the art that the reverse design and button functionality herein discussed may be used where easy jacket/garment removal is needed, such as jackets for medical professionals.

The term "jacket" is used to generally describe embodiments of the present invention. It should be understood that "jacket", as herein defined and described, is intended to encompass all outer garments intended for keeping an individual warm, such as coats and gilets, that open/close vertically along a sidewall of the jacket. This differs from, for example, a smock, the primary purpose of which is to protect clothing (not insulate) and generally is made of a lightweight material. As used herein, the terms "front" and "back" of a jacket or garment correlate to the front and back sides of a person. For example, a front side of a jacket is the side that is designed to be worn on the front side of a person.

Figure 1:
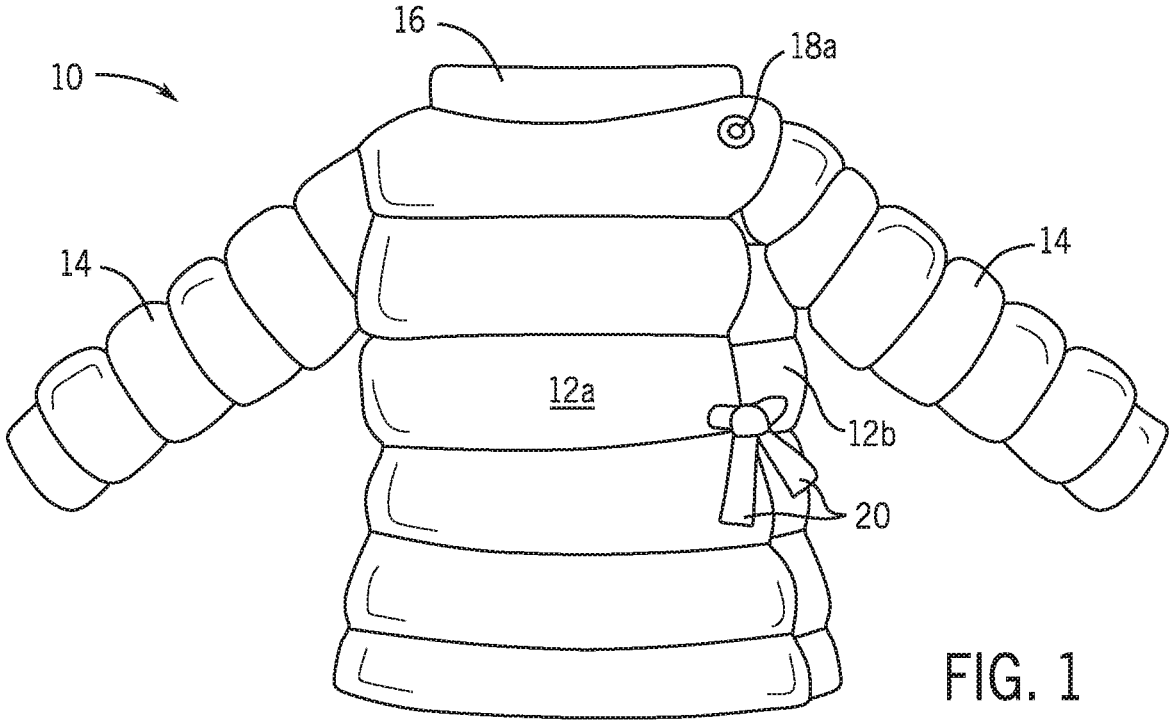
FIG. 1 is a rear elevation view of a first embodiment of the present invention, shown in a closed configuration.

Referring now to FIGS. 1-6, embodiments of the present invention allow a parent, or other individual, to take off and put on a child's jacket in a streamlined manner. In particular, the jacket is easily removable when the child is in a seated position (like in a car seat), or even a laying position of the child (such as when he/she is asleep). A garment, embodied as a technical jacket 10 formed from and/or including an insulative material, includes a first back flap 12*a*, a main body 12*b* (which includes a front portion and a second back flap integral with one another), a pair of arm sleeves 14 (which may be long or short depending upon function), and a collar 16. The first back flap 12*a* overlays the second back flap of the main body 12*b* when the jacket is closed, as shown in FIG. 1, among others (compare with the open configuration of the jacket 10, shown in FIG. 3). The first back flap 12*a* and the main body 12*b* in combination form the shell of the jacket 10 that covers the torso/chest/shoulder region of a person. In certain embodiments, the sleeves 14 are at least partially connected to the main body, and in other embodiments, one of the sleeves 14 may be at least partially connected to the first back flap 12*a*.

Figure 3:
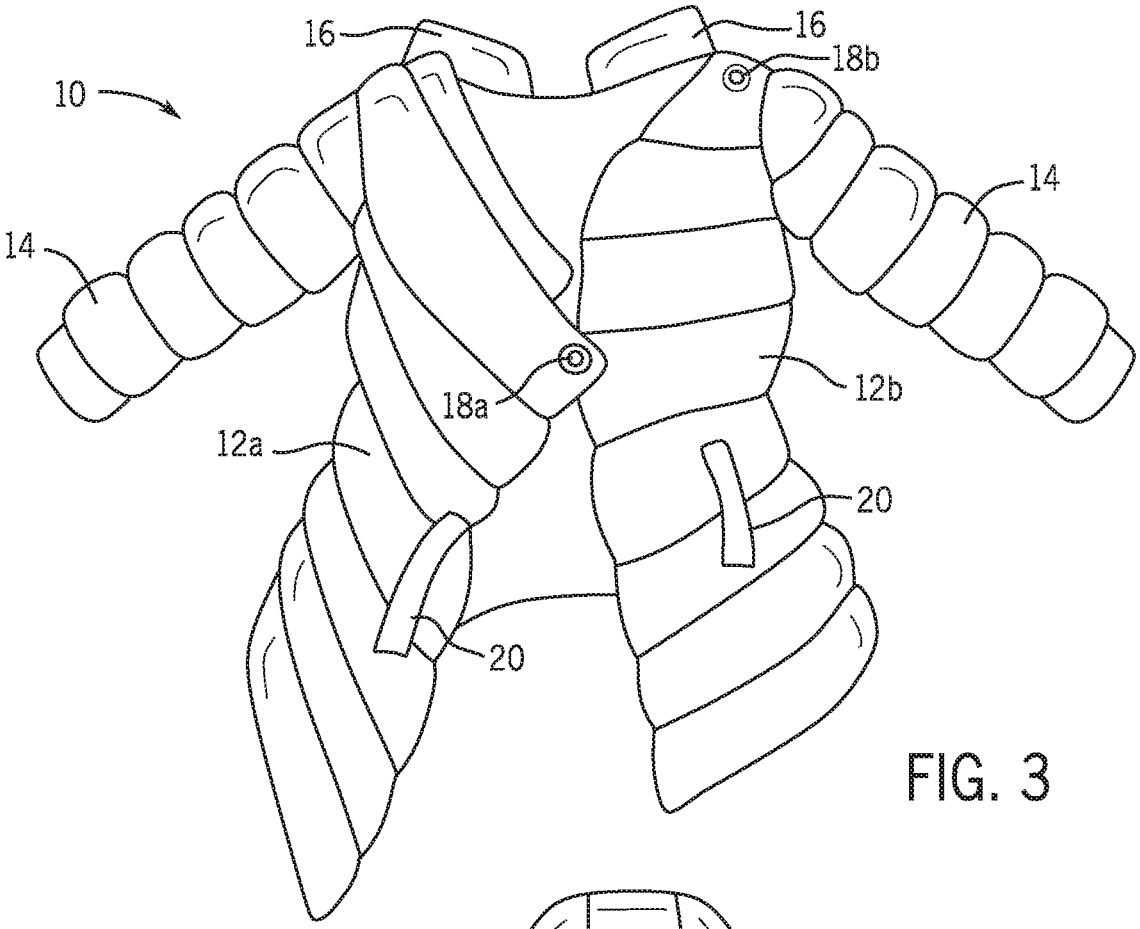
FIG. 3 is a rear elevation view of the first embodiment of the present invention, shown in an open configuration.

As shown in FIG. 3, the first back flap 12*a* and second back flap are disposed substantially on the back side of the jacket 10 and, in an open configuration, form an opening therebetween. This opening is intended for an individual to put on and remove the jacket 10, which is conventionally provided on the front side of a jacket. The opening being defined on the back side of the jacket 10 proves especially advantageous for removing the jacket 10 when an individual is in a seated position, such as a car seat. Rather than the jacket 10 being pinned between the individual wearing the jacket 10 and a back of a seat, it can easily be pulled straight away from the individual. Further, the jacket 10 may now be pulled off in a direction that the individual's arms more naturally directed (i.e. forward).

Figure 2:
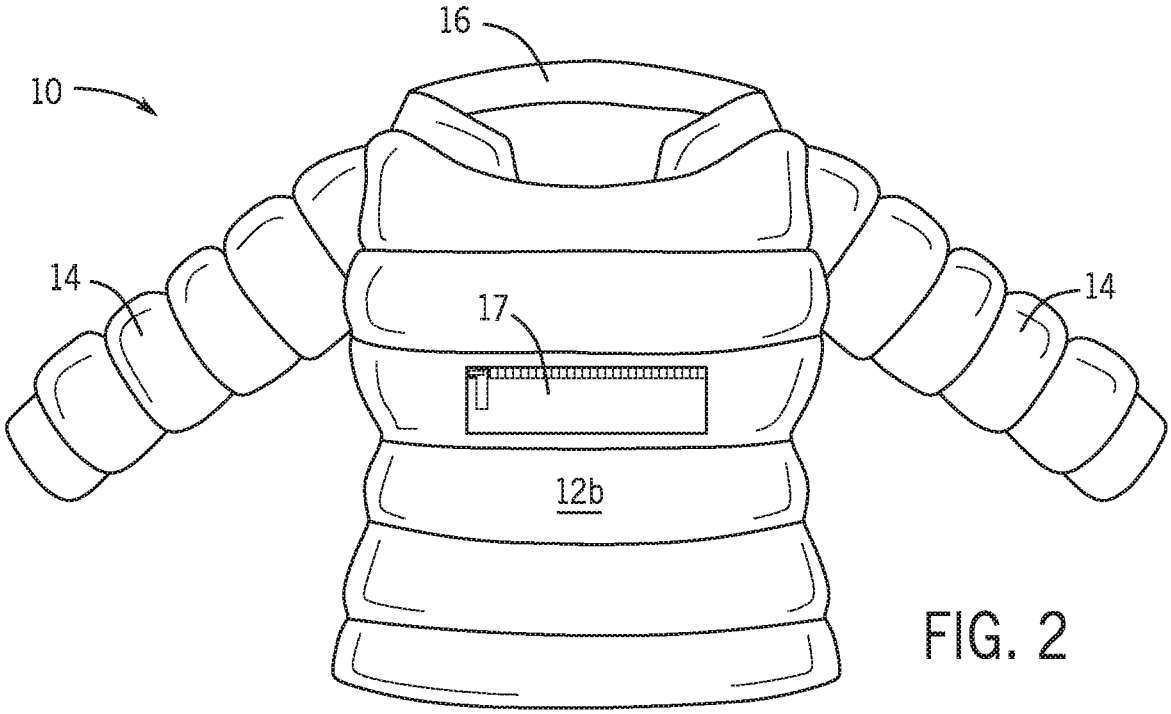
FIG. 2 is a front elevation view of the first embodiment of the present invention, shown in the closed configuration.

As shown in FIG. 2, the collar 16 may include an opening on its front side to allow additional room for the wearer's head/chin/neck. The collar 16 is made from a flexible material, which is of particular use for children in a seated position. There may further be provided a zippered pocket 17 on a front side of the main body 12*b*, as shown in FIG. 2. While only the front view is shown in FIG. 2, it should be understood that the front sides of all the embodiments may take a similar structure to that of FIG. 2. In certain embodiments, the zippered pocket 17 may be omitted.

As shown in FIG. 3, an upper end (i.e. shoulder area) of the first back flap 12*a* includes a first connector 18*a*, which may be embodied as a snap button. An upper end (i.e. shoulder area) of the second back flap of the main body may include a complementary second connector 18*b*, which releasably mates with the first connector 18*a* to connect the second back flap to the first back flap 12*a*. Because of the advantageous location of the connectors 18*a*, 18*b* at the top of the technical jacket 10, they are easy to access by a parent when a child is in the seated position (such as in a car seat), despite the connectors 18*a*, 18*b* being located on the back side of the jacket 10. It will be appreciated, of course, that the connectors 18*a*, 18*b* may be any appropriate type of mating fastener that achieves the functionality described herein, such as a button and slit for the button to extend through.

Figure 4:
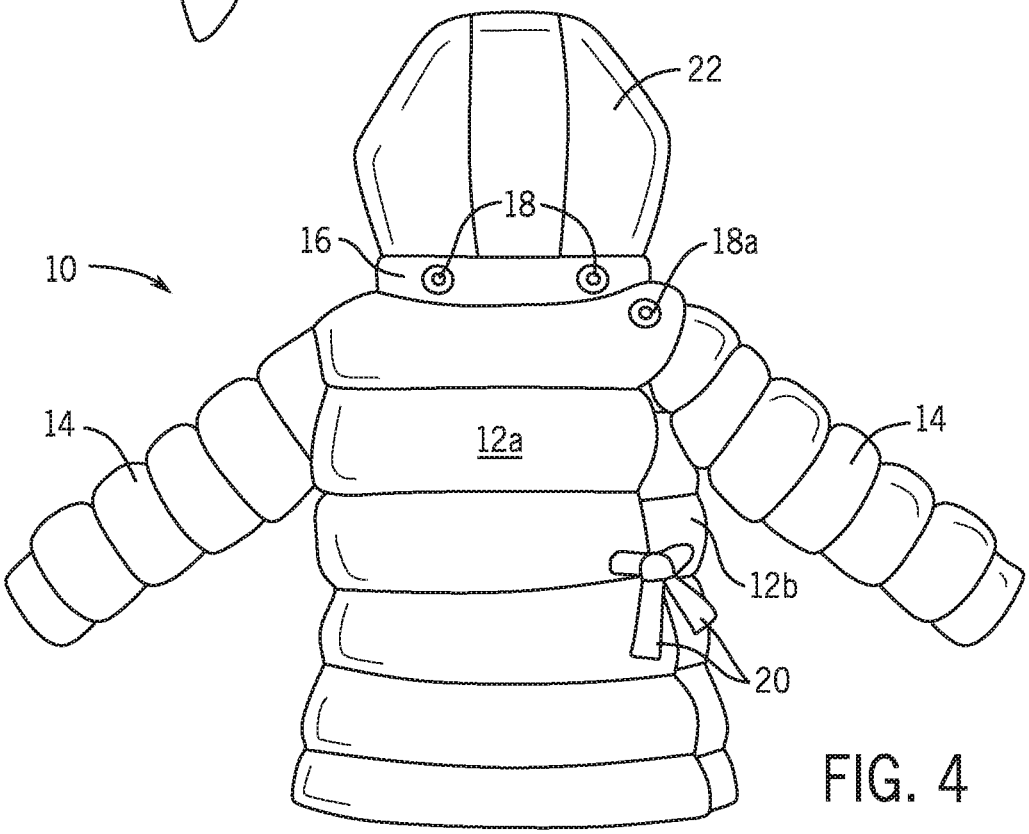
FIG. 4 is a rear elevation view of the first embodiment of the present invention, shown in a closed configuration with a hood attached.
Figure 5:
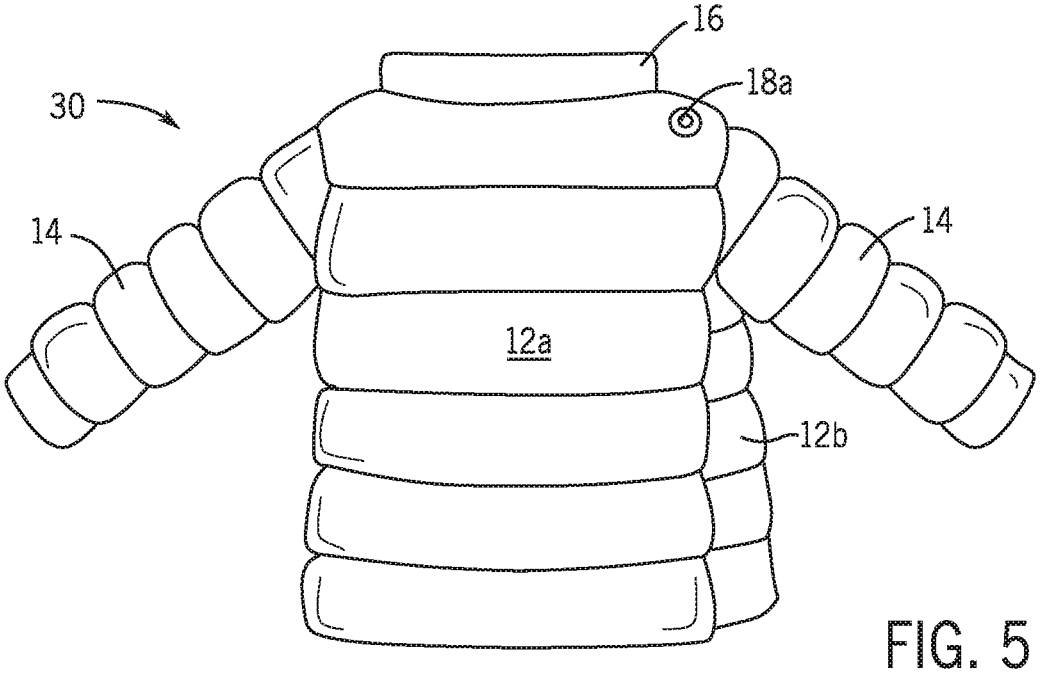
FIG. 5 is a rear elevation view of a second embodiment of the present invention, shown in a closed configuration.
Figure 6:
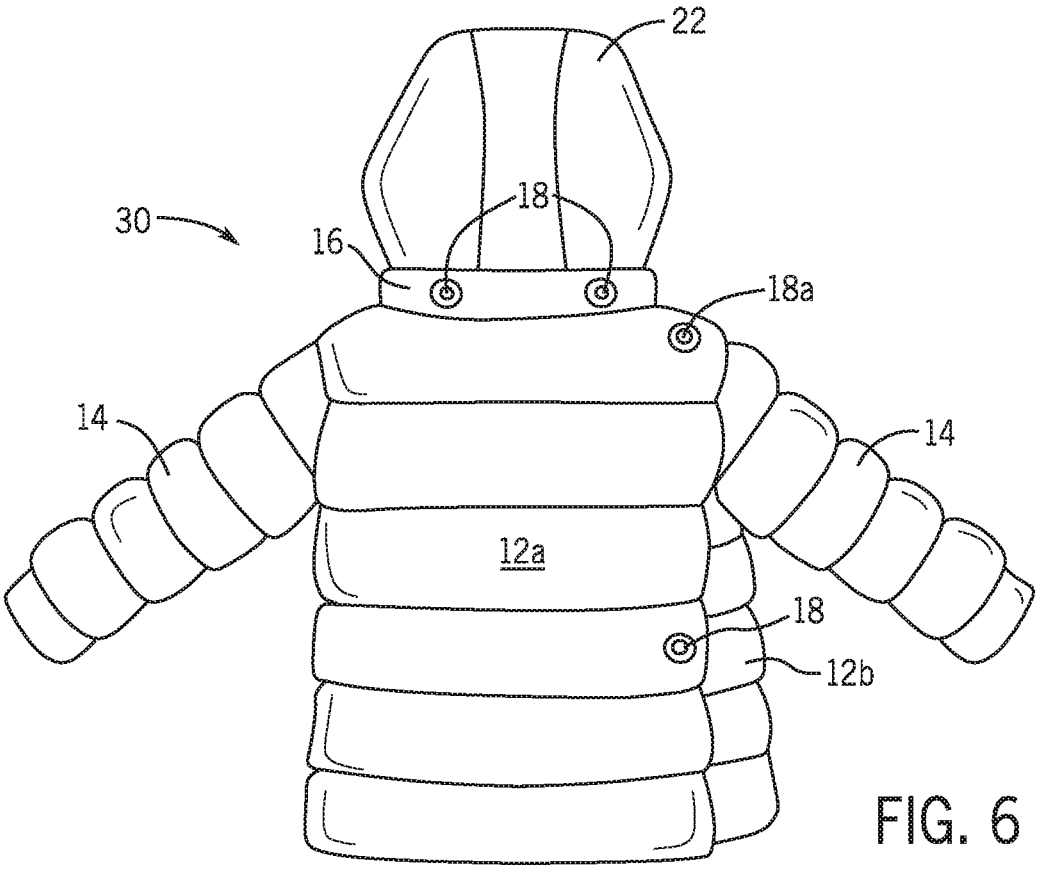
FIG. 6 is a rear elevation view of a modified version of the second embodiment of the present invention, shown in in a closed configuration with a hood attached.

As shown in FIGS. 4 and 6, various embodiments of the present invention may include additional connectors 18, embodied, for example, as snap buttons in the embodiments shown in FIGS. 4 and 6. Additional connectors 18 may be disposed on a back side of the collar 16 to connect to a removable hood 22. In certain embodiments, the hood 22 may be permanently attached to the back side of the collar 16. The back side of the collar 16, previously referenced, is connected to the first back flap 12*a*, as shown in FIGS. 3 and 4. Additional connectors 18 may also be utilized in a midsection of the back of the jacket 10, as shown in FIG. 6. When the wearer is, for example, walking or standing outside, these additional connectors help to secure the first back flap 12*a* in place with the second back flap of the main body 12*b*. As shown in FIGS. 1, 3 and 4, ribbons 20 may instead be used to secure a central portion of the jacket 10 in place. FIGS. 1-4 generally illustrate a jacket 10 that is intended for a female to wear, while FIGS. 5-6 generally illustrate a jacket 30 intended for a male to wear. Of course, it will be appreciated that any gender jacket may incorporate various design elements and connectors described in all of the figures.

A method of making the present invention may include the following. First, the material(s) for the jacket are selected. Then, the materials are transformed, using various known processes to form garments (such as cutting, sewing, bonding, etc.), into the shape of the jacket, forming the opening for the jacket in the rear of the jacket. Connectors to be used to secure the jacket in the shoulder area and, optionally, in the midsection are then selected and attached to the jacket. A hood with connectors to connect to a collar of the jacket may also be manufactured using similar processes.

A method of using the present invention may include the following. First, an individual may put the jacket on a child by sliding the jacket sleeves onto the child's arms and closing the opening in the jacket formed to be on the back side of the child when the child wears the jacket. The opening in the jacket is closed by securing complementary connectors in the shoulder area of the child. When a child sits down, such as in a car seat, the jacket may be removed by detaching the complementary connectors and pulling it off. Because the jacket opening is disposed on the back side of the child, it can be pulled directly away from the seated child by pulling on, for example, both arms of the jacket or a front side of the jacket.

It should be understood, of course, that the foregoing relates to exemplary embodiments of the invention and that modifications may be made without departing from the spirit and scope of the invention as set forth in the following claims.

What is claimed is:

1. A jacket defining a front side and a back side, the jacket comprising:

a first back flap defining a first back flap vertical edge;

a main body including a front portion and a second back flap defining a second back flap vertical edge;

a first back flap connector coupled to the first back flap proximal the first back flap vertical edge; and a second back flap connector coupled to the second back flap distal the second back flap vertical edge, the first back flap and the second back flap being detachably connectable to one another via the first back flap connector and the second back flap connector to selectively open and close an opening on the back side of the jacket such that, when closed, the first back flap overlays the second back flap.

2. The jacket of claim 1, wherein the first back flap and the second back flap are disposed substantially on the back side of the jacket.

3. The jacket of claim 1, further comprising:

a pair of sleeves at least partially connected to the main body.

4. The jacket of claim 1, wherein the first back flap comprises a first connector disposed on an upper end of the first back flap and the second back flap comprises a second connector disposed on an upper end of the second back flap, the first connector and the second connector detachably connecting to one another to selectively open and close the opening on the back side of the jacket.

5. The jacket of claim 1, further comprising:

a hood detachably connectable to a collar, the collar being connected to an upper end of the first back flap.

6. The jacket of claim 1, wherein the first back flap and main body each comprise an insulative material.

7. A garment defining a front side and a back side, the garment comprising:

a first back flap defining a first back flap vertical edge and comprising a first back flap connector disposed on an upper end of the first back flap and proximal the first back flap vertical edge;

a main body including a front portion and a second back flap, the second back flap comprising a second back flap connector disposed on an upper end of the second back flap and distal the second back flap vertical edge;

a pair of sleeves at least partially connected to the main body, the first back flap and the second back flap being detachably connectable to one another via selective coupling and uncoupling of the first connector and the second connector to open and close an opening on the back side of the garment such that, when closed, the first back flap overlays the second back flap.

8. The garment of claim 7, wherein the first back flap and main body each comprise an insulative material.

9. A garment defining a front side and a back side, the garment comprising:

a first back flap defining a first back flap vertical edge;

a collar connected to an upper end of the first back flap;

a hood connected to the collar;

a main body including a front portion and a second back flap defining a second back flap vertical edge;

a first back flap connector coupled to the first back flap proximal the first back flap vertical edge;

a second back flap connector coupled to the second back flap distal the second back flap vertical edge;

a pair of sleeves at least partially connected to the main body; and the first back flap and the second back flap being detachably connectable to one another via the first back flap connector and the second back flap connector to selectively open and close an opening on the back side of the garment such that, when closed, the first back flap overlays the second back flap.

* * * * *